US005898237A

United States Patent [19]

Birging et al.

[11] Patent Number: 5,898,237

[45] Date of Patent: Apr. 20, 1999

[54] DEVICE FOR INTERRUPTING THE POWER SUPPLY TO AN OBJECT

[76] Inventors: Torbjörn Birging, Västra Löa; Carl-Gösta Ardesjö, Vesterby Löa, both of Kopparberg, Sweden, 714 94

[21] Appl. No.: 08/836,273

[22] PCT Filed: Oct. 27, 1995

[86] PCT No.: PCT/SE95/01273

§ 371 Date: Apr. 28, 1997

§ 102(e) Date: Apr. 28, 1997

[87] PCT Pub. No.: WO96/13846

PCT Pub. Date: May 9, 1996

[30] Foreign Application Priority Data

Oct. 28, 1994 [SE] Sweden ..... 9403714

[51] Int. Cl.[6] ..... H01H 47/00

[52] U.S. Cl. ..... 307/125; 307/139; 307/141

[58] Field of Search ..... 307/30, 112, 113, 307/116, 125, 139, 140, 141, 141.4, 141.8

[56] References Cited

U.S. PATENT DOCUMENTS 4,782,420 11/1988 Holdgaard-Jensen ..... 361/58

FOREIGN PATENT DOCUMENTS

| | | |
|---|---|---|
| 931551 | 10/1994 | European Pat. Off. . |
| 3044235 A1 | 6/1982 | Germany . |
| 2 133 232 | 7/1984 | United Kingdom . |
| 94/22065 | 9/1994 | WIPO . |

OTHER PUBLICATIONS

*Helios* (1994); brochure cover and p. 84.

*Primary Examiner*—Jeffrey Gaffin
*Assistant Examiner*—Jonathan S. Kaplan
*Attorney, Agent, or Firm*—Jacobson, Price, Holman & Stern, PLLC

[57] ABSTRACT

A device is provided for interrupting the power supply to an object and is characterized in that it has elements (1, 2, 11) for effecting at which time the power supply shall be interrupted. The device is particularly adapted for use in connection to electrical stoves, as its function is such that accidents occurring because of overheating of stove plates or setting of fire to foodstuffs and the like used in connection to use of the stove can be avoided, and an obvious advantage in comparison to conventional stoves is thus obtained.

16 Claims, 1 Drawing Sheet

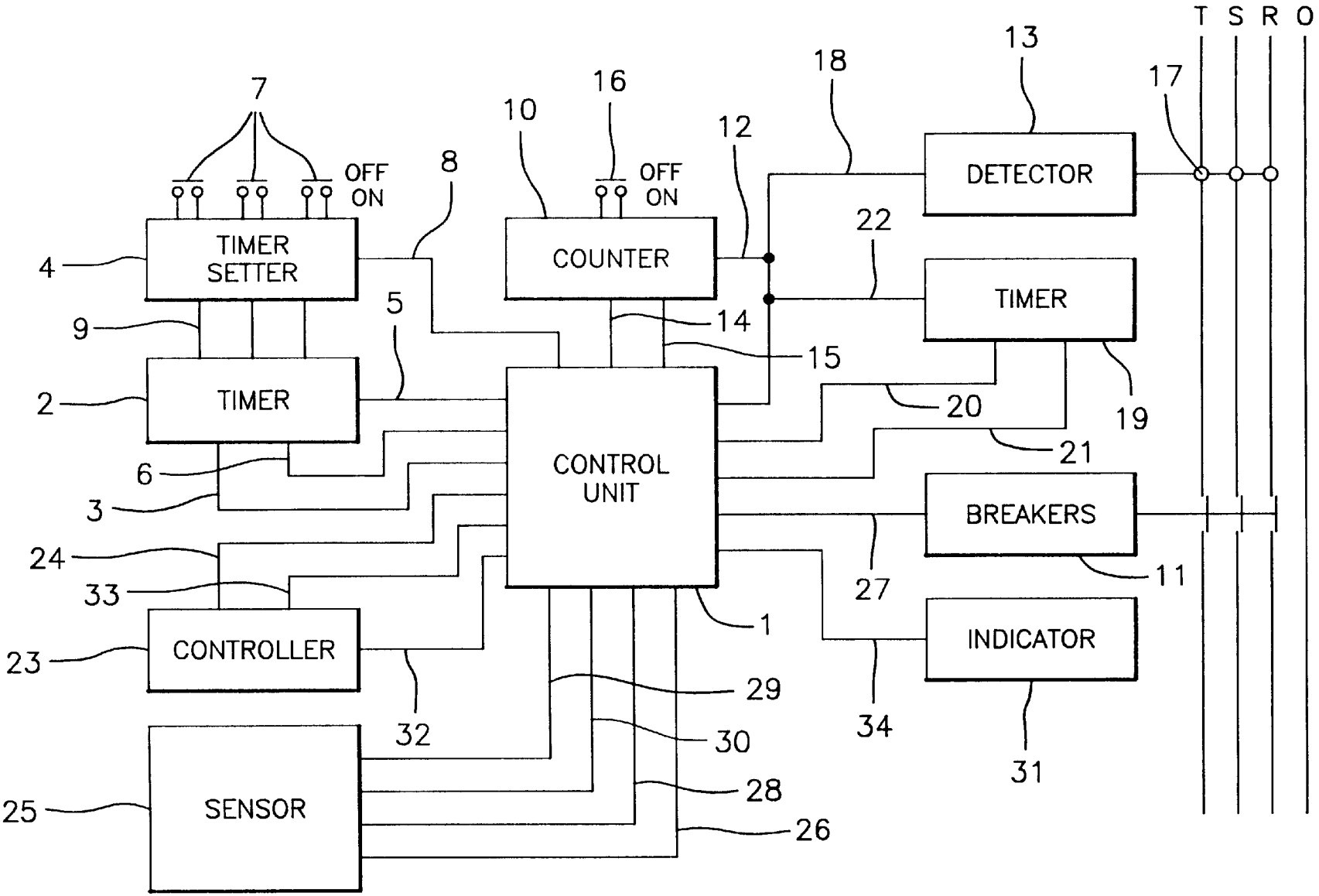
T S R O
17
DETECTOR
13
TIMER
19
21
20
BREAKERS
11
INDICATOR
31
18
22
27
34
12
15
14
COUNTER
OFF
ON
16
10
CONTROL UNIT
1
29
30
28
26
8
5
32
TIMER SETTER
OFF
ON
7
TIMER
CONTROLLER
SENSOR
4
9
2
6
3
24
33
23
25

DEVICE FOR INTERRUPTING THE POWER SUPPLY TO AN OBJECT

FIELD OF THE INVENTION AND PRIOR ART

This invention relates to a device for interrupting the power supply to an object, particularly after a certain operation time or after an alarm from any device associated with the present device and adapted to this target. Stoves are here treated as an example of such an object, the stoves forming arrangements by which it is possible to substantially reduce the risks by means of a device according to the present invention for such accidents that have occurred at a large number of occasions as stove plates have been overheated or as objects located on the stove plate has caught fire due to the heat thereof.

Investigations show that a large number of accidents occur through overheated objects being set on fire. Accordingly, by way of example, 30% of all the fires in homes are caused by electrical stoves, i.e. because of the user having forgotten to turn off the stove. Also in those cases where such negligence does not cause fire, other economical damage is obtained, such as damaged hot plates and/or cooking vessels due to excessive heating.

Due to similar reasons, and to avoid wasting energy in vain, it is also an advantage to be able to control the power supply to an oven included in a stove so that the power supply is interrupted after a certain operation time or at a given alarm signal from any alarm device associated with the oven.

It is known per se to arrange means or arrangement for interrupting the power supply to objects heated by means of the power supply and thereby running the risk of being overheated. However, such means or arrangements have the disadvantage of having only a thermostat function and will turn the power supply off only on the basis of the temperature of the object in question. Then, as the temperature is under a certain value, they will once again make the power supply possible. Any permanent interruption of the power supply to the object when the latter has been used for certain time or reached the temperature which is too high will not be effected by these devices of prior art.

SUMMARY OF THE INVENTION

The object of the present invention is to provide a device for interrupting the power supply to an object, particularly a stove, and more precisely the hot plates or the oven thereof, to obtain advantages in comparison to stoves of a conventional type with reference to safety aspects and economical aspects, regard being taken to the elapsed time at every occasion when the object is used.

Therefore, the device according to the invention comprises means for effecting at which time, that is to control when, the power supply is to be interrupted.

In a preferred embodiment of the invention, these means comprise a timer with which a desired operation time of the object can be set.

According to another preferred embodiment, the object itself has one or more own power supply breakers, which as in the case of stoves, can comprise knobs which are maneuvered by hand by the one handling the object. They may comprise breakers associated to possible thermostat functions of the object in question. If the user of the object would forget to turn the power supply off through the object's own breakers, the device will, accordingly, effect the accomplishment thereof as a set operation time has passed or, as will be explained hereinafter, after a certain number of on- and off-switching cycles regarding the power supply to the object has occurred or an alarm signal has been given to the device.

According to yet another preferred embodiment, the device also comprises means for keeping the power supply to the object interrupted until the object's own breakers are open. Thereby, particularly breakers maneuverable by hand are referred to, such as a those associated to knobs present at stoves. An advantage obtained through this characteristic is that the user thereby has to actively open the power supply breakers of the object before power once again can be supplied to the object. Of course, this reduces the risks for possible accidents.

According to another preferred embodiment of the device according to the invention, this one comprises means which only at a period of interruption of the power supply to the object that exceeds a predetermined value will reset the timer to once again start from zero, that is from the beginning, during its measure of the operation time. Power supply interruptions that are controlled by thermostat or caused by the user and the length of which is such that it goes below the above, predetermined time period, will not effect the timer's counting of the operation time. Thus, in the case with stoves, the user can turn the power supply of the stove off for a shorter period without thereby resetting the timer, which is an advantage in certain situations.

In another preferred embodiment, the devices are provided with means for detecting whether the object's own power supply breakers are closed or not. Thereby a condition is created for certain other functions accomplishable by the device in different embodiments.

Accordingly, the device according to yet another embodiment is also characterized in that it comprises means which, as the power supply to the object has been interrupted by the device, make the means for detecting whether the object's own breakers are closed or not to execute it's detecting function with a time period which, between the detecting function occasions, step-wise becomes longer. Every time such a detection is made, the object is supplied with a small amount of power. If this is done regularly and with pauses that are too short, the object remains at an unacceptably high temperature if it, by way of example, is a stove plate which is supplied with current. With this embodiment, this problem is solved as the periods of the pauses initially are short but then successively becomes longer. In that way, it is possible to obtain body temperature as final temperature also for a high effect stove plate set at maximum effect.

According to another characteristic, the device comprises means effecting the maintenance of the time period between the detecting function occasions at a predetermined, maximum value after said time period having been increased to this value. For a stove plate typically around one minute. Thereby, the power supply to the object can rapidly be regained after the power supply breakers of the object having been re-opened, e.g. after the knobs having been reset, because the device, when having determined that this is the case by means of the detecting means, re-closes it's own breakers.

According to another embodiment of the device according to the invention it also comprises a means effecting the interruption of the power supply to the object as the power supply has been switched on and off respectively a predetermined number of times by the object's own breakers without the timer having been allowed to reach the end of the operation time. According to yet an embodiment this means is connectably and deconnectably arranged and is connected depending on which part of the object that is supplied with power. In the case of a stove, this part of the object, that is the stove, is preferably constituted by the oven, as the thermostat function of ovens normally is such that the interruption periods as to power supply are of such length that a timer function, as described above, time after time would reset the timer. Thus, this problem is remedied through these characteristics.

BRIEF DESCRIPTION OF THE DRAWING

Further advantages and characteristics of the device according to the present invention will appear from the following description in detail of a preferred embodiment, made with reference to the disclosed drawing, which shows a block diagram for the device according to the invention.

DETAILED DESCRIPTION OF A PREFERRED EMBODIMENT

The figure shows the different units which make part of the device according to the invention, the object supplied with power, here by means of three phase feeding, being formed by a stove, preferably an electrical stove. Preferably, also the device according to the invention is driven by power from the same source as the one of the object.

To handle the signalling between these units, the device comprises a control unit 1 which here is formed by a micro controller with a computer program adapted to the handling of signals.

Here, the means, as described above, for effecting the time when the power supply to an object is to be interrupted comprises a timer 2 which picks up an operation time from a block 4 for time setting as a signal is given from the control unit 1 via a conductor 3 to its start-timer-inlet, and counts this period down to zero. Simultaneously with the pick-up of operation time the output of said means are set to zero. When the period or time has been count down to zero a signal is given to the control unit via a conduct 5. Furthermore, via another conduct 6, a signal is given to the control unit already when a predetermined time remains of the set period. When this predetermined time remains of the operation time, the device determines whether power supply to the object is taking place by means of detecting means which will be further described later. If the device finds that there is no power supply to the object at this occasion, it waits for such a supply to occur and then, as soon as this occurs, interrupts the power supply by means of it's breakers 11. Therefore, the time of use can at minimum be operation time minus a predetermined time, and at maximum be the operation time.

In the preferred embodiment, the setting of the operation time is effected by choosing an on-position or off-position at the three switches 7, which results in eight different combination possibilities. One of the possibilities, here in the case when all switches are in their off-position, is that no time is to control the device. Then, a signal is given from the time setting block 4 via a conduct 8 to the control unit 1. The remaining combination possibilities give different operation times which, via conducts 9, is picked up by the timer.

The device is also provided with a counting means 10 which effects that the power supply to the object is interrupted by the device as the power supply to the object has been switched on and interrupted a predetermined number of times through the object's own breakers without the timer 2 having been permitted to reach the end of the operation time. In the block diagram this counting means is illustrated by the block 10, and is, via a conduct, directly connected to a means 13 for detecting whether the own power supply breakers of the object supplied with power are closed or not. Via conducts 14, 15 this means is also connected to the control unit and can be switched on or off by means of a switch 16 depending on which part of the object that is supplied with power. In the preferred embodiment, the part supplied with power when the counting means is supposed to be switched on is the oven of a stove.

In the preferred embodiment, the detecting means comprise a unit represented by means of a block 13. Preferably this unit comprises means for measuring if the current is flowing in the input conducts of the object, these means advantageously being comprised by coils 17 and measuring being done inductively. Suitably the detecting means are arranged so that only loads exceeding a certain value are registered as load, that is power supply. This is to avoid registering the current flowing to, for example, an oven lamp, a transformer etc. of a stove as load, but only the current that flows to supply hot plates and oven. When the object is a stove, the value preferably is approximately 50 watt. Through a conduct 18 these means output signals to the control unit regarding the power supply to the object.

Furthermore, the device comprises a means 19 which, during a break of the power supply to the object, measures the time of this break. Here, break in the power supply is referred to as a load which goes below the load which the detecting means register as load. In the block diagram this means is represented by the block 19 and is connected to the control unit through the conducts 20, 21, and to the output of the detecting means through a conduct 22. It is initiated and reset to zero through a signal at the conduct 21 from the control unit as the latter has obtained a signal from the detecting means that confirms that no load is present. As the time of no load, break, exceeds a predetermined value, this means 19 outputs a signal to the control unit 1 indicating that this is the case. In the preferred embodiment, at this signal, the control unit is programmed to bring the means 2 for effecting the time of power supply interruption, here the timer, to once again start from zero, that is from the beginning, at its down counting of the operation time.

Accordingly, at a break in the power supply to the object which exceeds a predetermined value as to time, the device comprises means 1, 13, 19 for bringing the means 2 for effecting the time at which the power supply is to be broken to restart its counting from the beginning.

Furthermore, the preferred embodiment of the device comprises means 23 which, as the power supply to the object has been interrupted by the device, through signalling at the conduct 32 to the control unit and further signalling from the latter, bring the means for detecting whether the object's own breakers are closed or not to execute their detection with a time period between the detecting function occasions which step-wise becomes longer. In the block diagram shown, these means comprise the block 23. When the device has interrupted the power supply to the object, this means 23, preferably through a signal at the conduct 32 to the control unit, controls the breakers of the device, which then are open, by means of signals to close for short periods with a step-wise longer pause between each respective occasion and thereby make it possible for the detecting means to determine whether the object's own breakers are closed. This function is initiated when the breakers 11 of the device by any reason, e.g. elapsed operation time, is brought to open by a signal from the control unit, the control unit giving a signal to this means to start its function through a conduct 24. The function is interrupted as soon as the detecting means 13 have found the object's own breakers no longer closed and have given a signal to the control unit 1 indicating this, and the control unit has forwarded this information to the means 23 by means of a signal on the conduct 33. The means 23 for executing this timer function is preferably arranged in such a way that it effects the maintenance of the time period between the detecting function occasions at a predetermined, maximum value after the step-wise increase of the time period to this value. For a stove, the first pause is preferably approximately 1 second, whereafter the length of the subsequent pauses is step-wise increased by, for example, 1 second at a time until a pause period of approximately 1 minute is obtained, and remains thereafter at this value.

The block diagram shown comprises also a unit symbolised by a block 25 the principal function of which is to function as an arrangement monitoring the object. Such a known arrangement does certainly already exist for the monitoring of stoves, and is described in the Swedish patent SE 8800625-9 (461 560) of the applicant. Signalling is here accomplished through conducts between this arrangement and the device according to the invention. The device according to the invention comprises means 1 which, at a given signal from the above arrangement 25, sees to that the power supply to the object in question is interrupted. Here, these means are formed by the control unit which, via a conduct 26, receives such signals and on the basis thereof output signals, via a conduct 27, to the breakers 11 of the device regarding interruption of the power supply to the object. Simultaneously a control unit also outputs a signal to the means 23 for creating a step-wise longer time period between the detecting function occasions to initiate its function.

Such signals from the monitoring arrangement 25 to the device according to the invention are preferably output by the arrangement in case of overheating of, for example, hot plates and/or forming of flames.

A further signalling taking place between the control unit 1 and the monitoring arrangement 25 refers to the possibility of occasionally deconnecting the means 2 for effecting the time for interruption of the power supply to the object, and said counting means 10, the control unit and the monitoring arrangement thereby constituting means for this function. Therefore, the monitoring arrangement is provided with a member for effecting this function which is maneuverable by a user, and when the member is maneuvered for such a function a signal is transmitted through a conduct 28 from the monitoring arrangement to the control unit. Suitably the de-connection only applies for one operation period, that is continues use of the stove with breaks in the use that go below the above mentioned, predetermined time, during which operation period the means 2 for effecting the time for interruption of the power supply to the object is not forced to start its down counting of the operation time from zero. If the control unit obtains a signal from the detecting means with reference to a pause which exceeds said time, the last mentioned means 2 and the counting means 10 will be reconnected.

Furthermore, the device according to the invention comprises a means for sending a signal to the monitoring arrangement which indicates that the object is supplied with power. Here, this means is constituted by the control unit 1 which, via a conduct 29, outputs a signal to a buzzer arranged in the monitoring arrangement, which buzzer then releases a sound to tell that the object now is supplied with energy, that is turned on. Suitably the monitoring arrangement is also arranged with a visual means which, during this signalling, is effected to execute a function which makes the operator aware of the object being supplied with energy. For example, the visual means may consist of a lamp which is brought to flash at a signal from the device. Suitably, said arrangement is also equipped with a switch for turning the sound of the buzzer off.

As the power supply to the object is interrupted, due to an alarm from said arrangement or due to the elapse of the operation time, a signal is given from the device to the monitoring arrangement via a conduct 30, whereby the monitoring arrangement, as it receives this signal, turns the buzzer and the visual means off. In connection to the subsequent, above described load test, the device, in a preferred embodiment, is also provided with means, in the shape of the control unit 1, which at the end of each pause send a signal to the monitoring arrangement which gives rise to a sound from the buzzer, this sound preferably being different from the sound which is released by the buzzer in connection to the turn on of the power supply to the object.

In the preferred embodiment, the device also comprises means for maintaining the device in a power supply interrupting state until a predetermined time has past after its installation or a power supply break of the network supplying the object with power. Here, these means comprise the control unit which, when the device has been subjected to lack of power supply, is programmed to transmit a signal via a conduct 27 indicating that the device's own breakers shall be kept open until a predetermined time has past.

Finally, it should also be mentioned that the device according to the preferred embodiment is provided with a visual means 31, preferably a light indicator which at a signal via a conduct 34 from the control unit is activated as the device obtains operational voltage after network voltage or after installation.

Of course the invention is not in any way restricted to the preferred embodiment described above, but a plurality of possibilities of modifications thereof should be obvious for a man skilled in the art without the embodiments thereby diverging from the very thought of the invention. For example, it is not necessary that the device according to the invention, as is the case in the preferred embodiment, is constituted by a plurality of discrete components or units in the way shown. Of course, the same result can be obtained with a system with integrated components.

The fact that, in the description, the device according to the invention has been exemplified such as applied to an electric stove, the power supply being referred to as current supply, does not mean that the device is delimited to application at such objects. Naturally, it can find use in a plurality of other contexts, and also where the power supply not necessarily refers to current supply, e.g. at gas stoves.

Furthermore, it shall be particularly noted that the phrase "effect at which time the power supply is to be interrupted" does not only refer to determination of the time for interruption by means of a timer, but that the expression should be understood as "control when the power supply is to be interrupted" and whereby this control then can be effected on a totally other basis than a measure of time, e.g. on the basis of registered overheating of hot plates or on the basis of certain number of on and off switches respectively of the object's own breakers.

We claim:

1. A device for interrupting power supply to an object having a first breaker, comprising:

means to effect at what time the power supply is to be interrupted, said means comprising a timer, by means of which a desired operation time of the object can be set, means for detecting whether the first breaker of the object is closed or not, a second breaker, responsive to said means to effect, to interrupt the power supply to the object, means, responsive to said means to effect, for keeping the power supply to the object interrupted, after the power supply having been interrupted by means of the second breaker, until the first breaker is opened, and for connecting the power supply to the object when the first breaker is opened, further comprising means for measuring, during a break in the power supply to the object, the duration of the power supply interruption and for delivering, only when the duration exceeds a predetermined value, a signal to a control unit adapted to, on receipt of this signal, cause the timer to once again restart counting of the operation time.

2. A device according to claim 1, further comprising a counting means which effects interrupting of the power supply to the object by the device when the power supply to the object has been initiated and interrupted a predetermined number of times via the first breaker without the timer having been allowed to reach the end of the operation time.

3. A device according to claim 2, wherein the first breaker are controlled through a thermostat function.

4. A device according to claim 1, wherein the counting means is operatively connected depending on which part of the object is supplied with energy.

5. A device according to claim 1 further comprising means for pre-setting the operation time in the timer.

6. A device according to claim 1, further comprising means effecting maintenance of the device in an energy supply interrupting state until a preset period has elapsed after installation of the device or after the occurrence of a break in the power supply of a network providing the device with energy.

7. A device according to claim 1, further comprising means which, at a given signal from an arrangement monitoring the object and associated to the device, effect the interrupting of the power supply to the object.

8. A device according to claim 1, wherein the object is a stove.

9. A device according to claim 1, wherein the power supply refers to supply of current.

10. A device for interrupting power supply to an object having a first power supply breaker comprising:

means to control when the power supply is to be interrupted, means for detecting whether the first power supply breaker of the object is closed or not, a second power supply breaker for breaking the power supply to the object, means for keeping, after the power supply having been interrupted by means of the second power supply breaker, the power supply interrupted until the first power supply breaker of the object is opened, and for connecting the power supply to the object when the first power supply breaker is opened, wherein, when the power supply to the object has been interrupted by the device, the means for detecting whether the first power supply breaker is closed or not to execute its detecting function with a longer period between detecting function occasions.

11. A device according to claim 10, wherein the said means to control comprises a timer by means of which a desired operation time of the object can be set.

12. A device according to claim 10, further comprising means which effect maintenance of a period between the detecting function occasions at a predetermined maximum value after the period having been increased to the predetermined maximum value.

13. A device according to claim 10, further comprising means which, at a given signal from an arrangement monitoring the object and associated to the device, effect the interrupting of the power supply to the object.

14. A device according to claim 10, wherein the object is a stove.

15. A device according to claim 10, wherein the power supply refers to supply of current.

16. A device according to claim 10, wherein the first breaker is controlled through a thermostat function.

* * * * *